US010527978B1

(12) United States Patent
Watanabe

(10) Patent No.: US 10,527,978 B1
(45) Date of Patent: Jan. 7, 2020

(54) IMAGE FORMING APPARATUS AND IMAGE FORMING METHOD FOR FORMING TONER IMAGE USING IMAGE DATA OR PREDETERMINED SHAPE

(71) Applicant: TOSHIBA TEC KABUSHIKI KAISHA, Shinagawa-ku, Tokyo (JP)

(72) Inventor: Takeshi Watanabe, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/172,590

(22) Filed: Oct. 26, 2018

(51) Int. Cl.

| | |
|---|---|
| ***G03G 15/16*** | (2006.01) |
| ***G03G 15/20*** | (2006.01) |
| ***G03G 15/08*** | (2006.01) |
| ***G03G 15/00*** | (2006.01) |

(52) U.S. Cl.
CPC ..... *G03G 15/2007* (2013.01); *G03G 15/0808* (2013.01); *G03G 15/6573* (2013.01); *G03G 15/2053* (2013.01); *G03G 2215/0651* (2013.01); *G03G 2215/1676* (2013.01)

(58) Field of Classification Search
CPC ..... G03G 15/161; G03G 15/5037
USPC ..... 399/307, 336
See application file for complete search history.

(56) References Cited

U.S. PATENT DOCUMENTS 5,666,598 A 9/1997 Sugita
8,200,135 B2 * 6/2012 Fujita et al. ..... G03G 15/161 399/307

* cited by examiner

*Primary Examiner* — William J Royer
(74) *Attorney, Agent, or Firm* — Foley & Lardner LLP

(57) ABSTRACT

An image forming apparatus includes an acquisition interface, a developer, and a transferring and fixing device. The acquisition interface acquires image data. The developer supplies toner to an image carrier to form any one of a toner image according to the image data and a toner image of a certain shape pre-determined regardless of the image data. The transferring and fixing device forms an image represented by the image data on an image forming target medium by irradiating a surface of the medium having another surface adjacent to the toner image with light having at least a certain value of a transmittance with respect to the medium to transfer and simultaneously fix some or all of the toner image on the other surface of the medium by the light that is transmitted through the surface of the medium. The toner is melted by the light.

18 Claims, 9 Drawing Sheets

IMAGE FORMING APPARATUS AND IMAGE FORMING METHOD FOR FORMING TONER IMAGE USING IMAGE DATA OR PREDETERMINED SHAPE

FIELD

Embodiments described herein relate generally to an image forming apparatus and an image forming method.

BACKGROUND

There is a demand to form an image by using an in-line printer that prints an image, such as a manufacturing date, on an image forming target object, such as packaging material formed of a transparent material, such as polyethylene or the like, via an electrophotographic method. The electrophotographic method is an image forming method in which an image is formed by toner by charging a photoconductor. An in-line printer that forms an image via the electrophotographic method needs to transfer toner to the image forming target object that has been conveyed, and then fix the toner on the image forming target object. Such an in-line printer may fix the toner by irradiating light, such as visible light, infrared rays, or the like. However, when the toner is fixed by being irradiated with the light, a flash process of irradiating the light needs to be performed after a transfer process of transferring the toner is performed. In such an in-line printer, a transfer unit that performs the transfer process and the flash unit that performs the flash process are sequentially arranged in a direction of conveyance of the image forming target object. In this regard, the in-line printer that forms an image via the electrophotographic method becomes large-scaled.

DETAILED DESCRIPTION

At least one exemplary embodiment provides an image forming apparatus including an acquiring unit, a developing unit, and a transferring and fixing device. The acquiring unit acquires image data. The developing unit supplies toner to an image carrier to form any one of a toner image according to the image data and a toner image of a certain shape pre-determined regardless of the image data. The transferring and fixing device forms an image represented by the image data on an image forming target medium by irradiating a surface of the image forming target medium having another surface adjacent to the toner image with light having at least a certain value of a transmittance with respect to the image forming target medium to transfer and simultaneously fix some or all of the toner image on the other surface of the image forming target medium by the light that is transmitted through the surface of the image forming target medium. The toner is melted by the light.

First Embodiment

Figure 1:
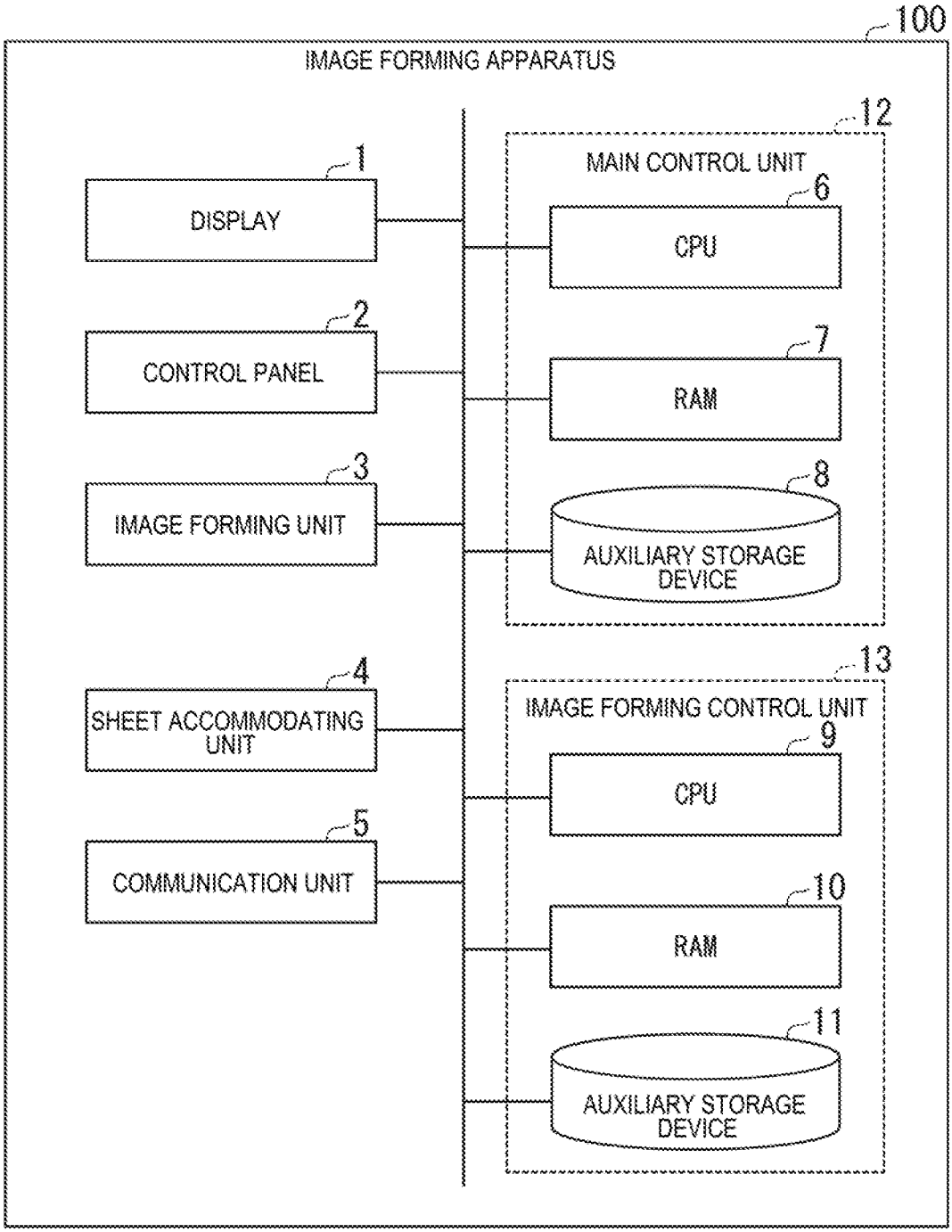
FIG. 1 is a diagram illustrating a concrete example of a hardware configuration of an image forming apparatus, according to a first embodiment.

FIG. 1 is a diagram illustrating a concrete example of a hardware configuration of an image forming apparatus 100, according to a first embodiment.

The image forming apparatus 100 includes a central processing unit (CPU) 6, a random access memory (RAM) 7, and an auxiliary storage device 8, and the like which are connected by a bus, and executes at least one program. The image forming apparatus 100 operates as an apparatus that includes a display 1, a control panel 2, an image forming unit (image former) 3, a sheet accommodating unit (a sheet storage) 4, a communication unit (a communication interface) 5, a CPU 9, a RAM 10, and an auxiliary storage device 11 which perform various operations according to execution of the at least one program. A main control unit (controller) 12 is operated when the RAM 7 reads a program stored in the auxiliary storage device 8, and the CPU 6 executes the program. An image forming control unit (image forming controller) 13 is operated when the RAM 10 reads a program stored in the auxiliary storage device 11, and the CPU 9 executes the program. The main control unit 12 controls the display 1, the control panel 2, the sheet accommodating unit 4, the communication unit 5, and the image forming control unit 13. The image forming control unit 13 controls the image forming unit 3.

The image forming unit 3 of the image forming apparatus 100 may be an apparatus that fixes toner, or may be an inkjet type apparatus. The image forming apparatus 100 acquires image data through the communication unit 5, which serves as an acquisition interface. A sheet is, for example, an original document or a piece of paper with text, graphic (s), or the like. The sheet may be any object as long as light of a first wavelength is transmitted at a certain first transmittance.

The display 1 is an image display apparatus, such as a liquid crystal display (LCD), an organic electro luminescence (EL) display, or the like. The display 1 displays various types of information on the image forming apparatus 100 and information supporting an operation of a user with respect to an image forming process. The information supporting the operation of the user may include, for example, icons corresponding to various functions of the image forming apparatus 100.

The control panel 2 includes a plurality of buttons. The control panel 2 receives an operation of the user. The control panel 2 outputs, to a controller of the image forming apparatus 100, a signal corresponding to the operation of the user. The display 1 and the control panel 2 may be configured as an integrated touch panel, for example.

The image forming unit 3 forms a visible image on the sheet, based on image data acquired through the communication unit 5. The image forming unit 3 forms a visible image on the sheet by an electrophotographic method. Also, the sheet where an image is formed may be a sheet accommodated in the sheet accommodating unit 4 or a sheet that is manually input. The sheet accommodating unit 4 accommodates a sheet used when the image forming unit 3 forms an image.

The communication unit 5 includes a communication interface to connect the host apparatus to an external apparatus. The communication unit 5 communicates with the external apparatus through the communication interface.

The auxiliary storage device 8 includes storage devices, such as a magnetic hard disk device, a semiconductor storage device, and the like. The auxiliary storage device 8 stores information on operations of the image forming apparatus 100.

The auxiliary storage device 11 includes storage devices, such as a magnetic hard disk device, a semiconductor storage device, and the like. The auxiliary storage device 11 stores information on operations of the image forming unit 3.

Figure 2:
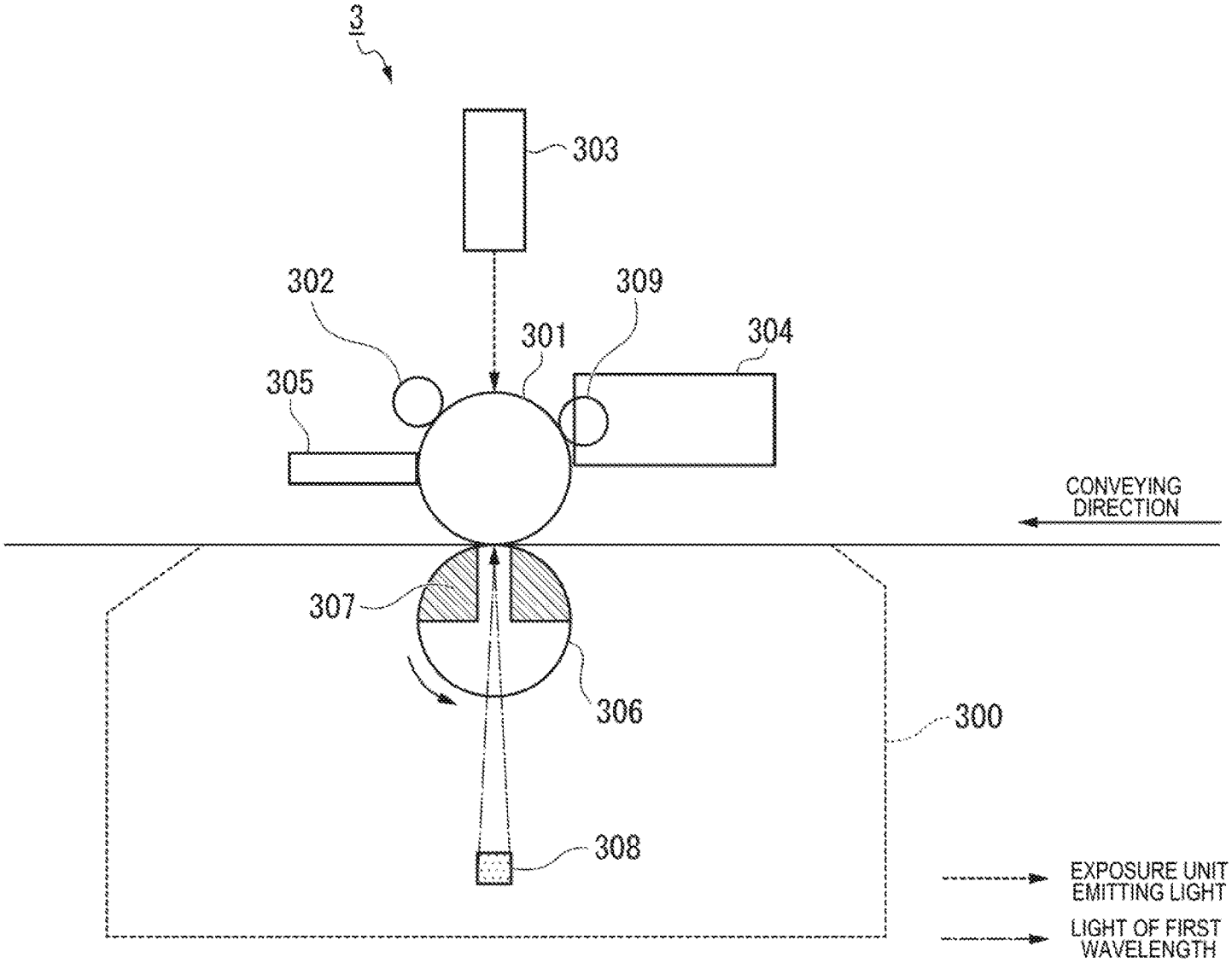
FIG. 2 is a cross-sectional view illustrating a concrete example of an image forming unit according to the first embodiment.

FIG. 2 is a cross-sectional view illustrating a concrete example of the image forming unit 3 according to the first embodiment. The image forming unit 3 includes a photoconductor 301, a charging roller 302, an exposure unit (exposer) 303, a developing unit (developer) 304, a cleaning unit (cleaner) 305, a transparent conveyor roller 306, a guide member (guide) 307, and a light emitting unit (light emitter) 308.

The photoconductor 301 is a drum-shaped rotating member having a chargeable surface. The charging roller 302 charges the photoconductor 301. The exposure unit 303 forms an electrostatic latent image according to image data on a surface of the photoconductor 301 by irradiating the charged photoconductor 301. The exposure unit 303 emits certain light (hereinafter, referred to as an "exposure unit emitting light") to expose the photoconductor 301.

The developing unit 304 includes a developing roller 309. The developing unit 304 develops the electrostatic latent image formed on the surface of the photoconductor 301, by using the developing roller 309. In detail, the developing unit 304 develops the electrostatic latent image by supplying toner to the photoconductor 301 through the developing roller 309. Here, the toner contains an absorbent absorbing a laser beam. The absorbent is, for example, an ultraviolet ray absorbent when the laser beam has a wavelength in an ultraviolet range.

The cleaning unit 305 cleans the toner on the surface of the photoconductor 301.

The transparent conveyor roller 306 is a hollow roller that transmits the light of the first wavelength at a certain second transmittance, and conveys a sheet by rotating the sheet. The transparent conveyor roller 306 inserts the sheet between the transparent conveyor roller 306 and the photoconductor 301. Hereinafter, a point where the photoconductor 301 and the sheet contact each other will be referred to as a photoconductor contact point. Also, a point where the transparent conveyor roller 306 and the sheet contact each other will be referred to as a roller contact point. Hereinafter, a direction in which the transparent conveyor roller 306 is located when viewed from the sheet will be referred to as a roller direction. Also, in the first embodiment, a surface of the sheet where the photoconductor 301 is located will be referred to as a photoconductor side sheet surface. Also, a surface of the sheet where the transparent conveyor roller 306 is located will be referred to as a roller side sheet surface.

The guide member 307 is located in a hollow region of the transparent conveyor roller 306 that is on a path through which the light of the first wavelength is transmitted, and guides the sheet to a certain destination. The guide member 307 transmits the light of the first wavelength and is positioned so as to direct the transmitted light. For example, the guide member 307 includes an opening at one portion thereof to transmit the light of the first wavelength. The guide member 307 may be formed of, for example, indium tin oxide (ITO). Hereinafter, for convenience of description, it is assumed that the guide member 307 includes the opening to transmit the light of the first wavelength. The guide member 307 applies pressure to the sheet. The toner is fixed to the sheet by the pressure applied by the guide member 307.

The guide member 307 may include two members with a gap therebetween. The light of the first wavelength passes through the gap in the guide member 307.

The light emitting unit 308 irradiates the light of the first wavelength towards the photoconductor contact point such that the light of the first wavelength is incident on the photoconductor contact point from the roller direction. The light of the first wavelength has a wavelength of a laser beam absorbed by the toner.

Also, the guide member 307, the transparent conveyor roller 306, and the light emitting unit 308 may operate together to function as a transferring and fixing device 300.

Next, the light of the first wavelength incident on the photoconductor contact point from the roller direction will be described with reference to FIG. 2. The light of the first wavelength emitted from the light emitting unit 308 is incident on a surface of the transparent conveyor roller 306. The transparent conveyor roller 306 transmits the light of the first wavelength at the certain second transmittance. Accordingly, some of the light of the first wavelength incident on the surface of the transparent conveyor roller 306 is transmitted up to the hollow region of the transparent conveyor roller 306. The light of the first wavelength transmitted up to the hollow region of the transparent conveyor roller 306 is incident on the opening of the guide member 307. The light incident on the opening of the guide member 307 passes through the transparent conveyor roller 306 again, and is incident on the roller contact point of the roller side sheet surface. Since the sheet transmits the light of the first wavelength at the certain first transmittance, the light of the first wavelength incident on the roller contact point of the roller side sheet surface is incident on the photoconductor contact point from the roller direction.

As such, the light of the first wavelength is incident on the photoconductor contact point from the roller direction.

Referring back to FIG. 1, the image forming control unit 13 performs an exposure unit control process, a photoconductor control process, a transparent conveyor roller control process, and a first light emitting control process.

The image forming control unit 13 controls operations of the exposure unit 303 by performing the exposure unit control process. The image forming control unit 13 controls emitting of the exposure unit emitting light onto the photoconductor 301 by performing the exposure unit control process to control operations of the exposure unit 303. Controlling of the emitting includes, in particular, controlling one or more of an emitting direction, timing, or intensity of the exposure unit emitting light. The image forming control unit 13 controls the emitting direction, timing, and/or intensity of the exposure unit emitting light to form the electrostatic latent image according to the image data on the surface of the photoconductor 301.

The image forming control unit 13 controls operations of the photoconductor 301 by performing the photoconductor control process. In detail, the image forming control unit 13 rotates the photoconductor 301 in a certain direction by performing the photoconductor control process to control operations of the photoconductor 301.

The image forming control unit 13 controls operations of the transparent conveyor roller 306 by performing the transparent conveyor roller control process. In detail, the image forming control unit 13 controls a rotating direction and rotating speed of the transparent conveyor roller 306 and causes the transparent conveyor roller 306 to convey the sheet by performing the transparent conveyor roller control process.

The image forming control unit 13 controls operations of the light emitting unit 308 by performing the first light emitting control process. The image forming control unit 13 causes the light emitting unit 308 to emit the light of the first wavelength by performing the first light emitting control process to control operations of the light emitting unit 308. A toner image at a region which is not irradiated with the light is developed, and all of the developed toner images are transferred to the sheet.

The image forming apparatus 100 according to the first embodiment configured as such includes, in the roller direction, the transparent conveyor roller 306 that transmits the light of the first wavelength at the certain second transmittance. Also, the sheet of the image forming apparatus 100 configured as such transmits the light of the first wavelength at the certain first transmittance. Accordingly, the image forming apparatus 100 may emit the light of the first wavelength incident from the roller direction to the photoconductor contact point. Thus, the image forming apparatus 100 may simultaneously melt, transfer, and fix the toner image, and upsizing of an image forming apparatus forming an image by an electrophotographic method may be suppressed.

Second Embodiment

Hereinafter, an image forming apparatus 100 according to the second embodiment will be described.

In the image forming apparatus 100 according to the second embodiment, an image forming unit 3*a* is different from the image forming unit 3 of the first embodiment. Also, in the image forming apparatus 100, the image forming control unit 13 is different from the image forming control unit 13 of the first embodiment. Further, according to the second embodiment, the sheet may be any sheet as long as an image is formable by the image forming apparatus 100. Unlike the sheet of the first embodiment, the sheet of the second embodiment does not necessarily need to transmit the light of the first wavelength at the first transmittance.

Also, a concrete example of a hardware structure of the image forming apparatus 100 according to the second embodiment is the same as that of FIG. 1 except functions of the image forming unit 3*a* and the image forming control unit 13.

Hereinafter, components other than the image forming unit 3*a* and the image forming control unit 13, which have the same functions as those of FIG. 1, will be denoted by the same reference numerals and details thereof will not be repeated.

Figure 3:
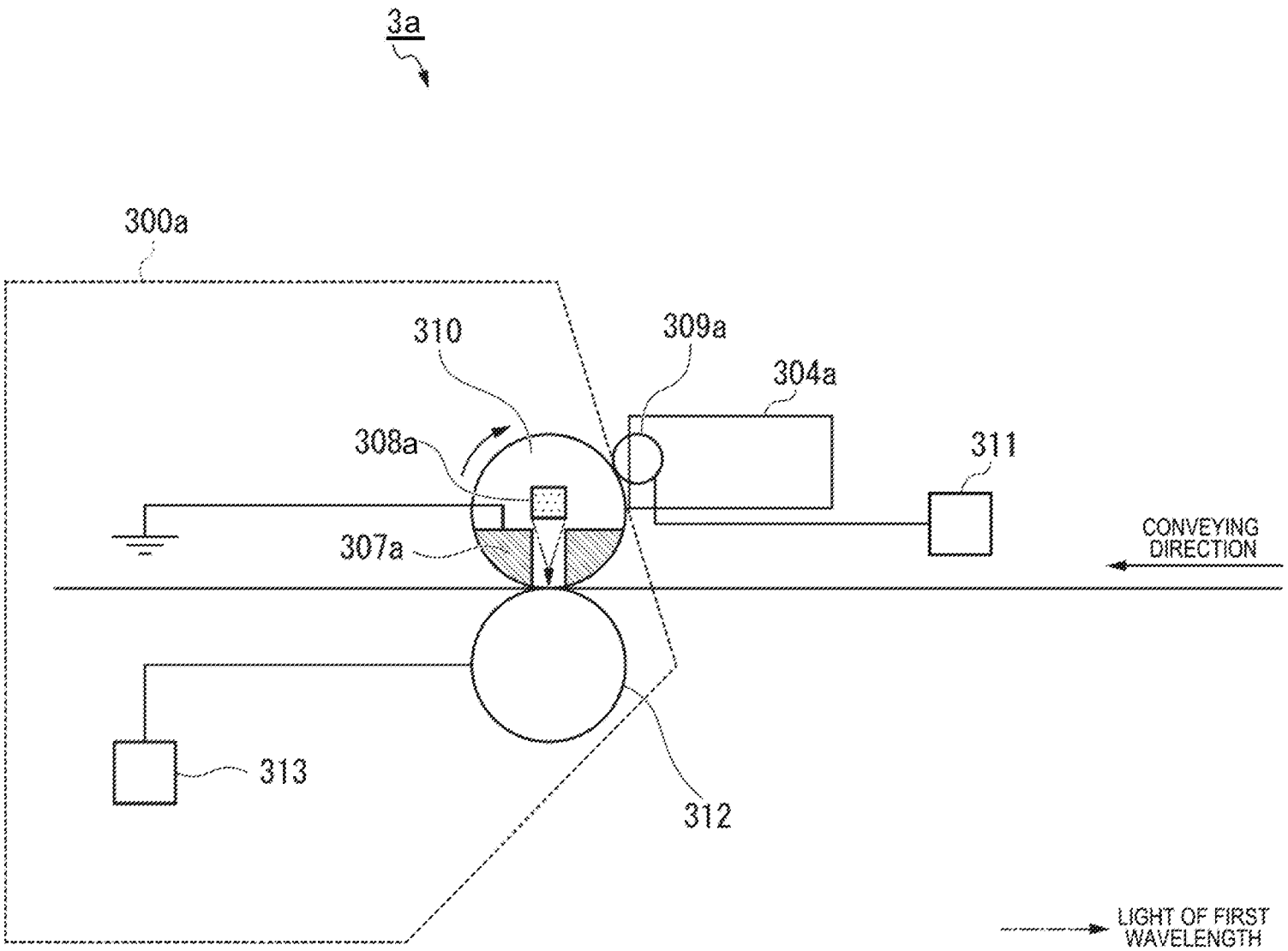
FIG. 3 is a cross-sectional view illustrating a concrete example of an image forming unit according to a second embodiment.

FIG. 3 is a cross-sectional view illustrating a concrete example of the image forming unit 3*a* according to a second embodiment. The image forming unit 3*a* includes an image carrier 310, a developing unit (developer) 304*a*, a first bias voltage applying unit (first voltage source) 311, a counter roller 312, a second bias voltage applying unit (second voltage source) 313, a guide member (guide) 307*a*, and a light emitting unit (light emitter) 308*a*.

The image carrier 310 has a surface formed of a conductive member, and is a rotating member with a hollow inside. The toner may be adsorbed onto the surface of the image carrier 310. The surface of the image carrier 310 may be grounded and have electric potential of about 0 V. The surface of the image carrier 310 transmits the light of the first wavelength at a certain third transmittance. In detail, the surface of the image carrier 310 may be formed of a material that is transparent with respect to a laser beam absorbed by the toner.

The developing unit 304*a* includes a developing roller 309*a*. The developing roller 309*a* is a conductive roller. The developing unit 304*a* supplies the toner to the image carrier 310 through the developing roller 309*a*.

The first bias voltage applying unit 311 applies a certain voltage to the developing roller 309*a*. The voltage (hereinafter, referred to as a "first bias voltage") applied to the developing roller 309*a* by the first bias voltage applying unit 311 may be any voltage as long as it is lower than the electric potential of the surface of the image carrier 310. In a case where the toner is negatively charged, the first bias voltage may be, for example −200 V when the electric potential of the surface of the image carrier 310 is 0 V.

The counter roller 312 applies, to the toner adsorbed onto the image carrier 310, a certain electric field based on an electric potential difference between the image carrier 310 and the counter roller 312. The counter roller 312 presses the toner onto the image carrier 310 according to an electromagnetic force caused by the applied electric field. The counter roller 312 is arranged opposite to the image carrier 310 with the sheet interposed therebetween. In other words, the counter roller 312 and the image carrier 310 face each other across the sheet. The counter roller 312 inserts the sheet between the counter roller 312 and the image carrier 310. Hereinafter, a point where the image carrier 310 and the sheet contact each other will be referred to as an image carrier contact point.

The second bias voltage applying unit 313 applies a certain voltage (hereinafter, referred to as a "second bias voltage") to the counter roller 312. The second bias voltage applied to the counter roller 312 by the second bias voltage applying unit 313 may be any voltage as long as it is lower than the electric potential of the surface of the image carrier 310. When the electric potential of the surface of the image carrier 310 is 0 V, the second bias voltage may be, for example −500 V.

Accordingly, in some embodiments, only the toner forming an image represented by the image data is drawn to the sheet by the second bias voltage.

The guide member 307*a* is located in a hollow region of the image carrier 310 that is on a path through which the light of the first wavelength is transmitted, and guides the sheet to a certain destination. The guide member 307*a* transmits the light of the first wavelength. For example, the guide member 307*a* includes an opening at one portion thereof to transmit the light of the first wavelength. The guide member 307*a* may be formed of, for example, indium tin oxide (ITO). Hereinafter, for convenience of description, it is assumed that the guide member 307*a* includes the opening to transmit the light of the first wavelength. The guide member 307*a* applies pressure to the sheet. The toner is fixed to the sheet by the pressure applied by the guide member 307*a*.

The guide member 307*a* may include two members with a gap therebetween. The light of the first wavelength passes through the gap in the guide member 307*a*.

The light emitting unit 308*a* is located at the hollow region of the image carrier 310 and emits the light of the first wavelength towards the image carrier contact point. The light emitting unit 308*a* emits the light of the first wavelength at timing based on the image data, and melts the toner adsorbed onto the surface of the image carrier 310.

Also, an image formed by the toner adsorbed onto the surface of the image carrier 310 before the light of the first wavelength is emitted is a toner image irrelevant to the image data. The toner image irrelevant to the image data may be, for example, a toner image adhered to the surface of the image carrier 310 without any gap. Also, the toner image irrelevant to the image data may be, for example, a toner image having a certain pattern, such as a honeycomb or grid pattern.

Also, the guide member 307*a*, the light emitting unit 308*a*, the developing roller 309*a*, the image carrier 310, the counter roller 312, and the second bias voltage applying unit 313 may operate together to function as a transferring and fixing device 300*a*.

The image forming control unit 13 according to the second embodiment will be described. The image forming control unit 13 performs a second light emitting control process, an image carrier control process, a first bias voltage control process, and a second bias voltage control process.

The image forming control unit 13 performs the second light emitting control process to control operations of the light emitting unit 308*a*. The image forming control unit 13 causes the light emitting unit 308*a* to emit the light of the first wavelength at timing based on a rotating speed of the image carrier 310 and the image data, by performing the second light emitting control process to control operations of the light emitting unit 308*a*.

The image forming control unit 13 performs the image carrier control process to control operations of the image carrier 310. In detail, the image forming unit 13 rotates the image carrier 310 in a certain direction at a certain speed by performing the image carrier control process.

The image forming control unit 13 controls the first bias voltage applied to the developing roller 309*a* by the first bias voltage applying unit 311 by performing the first bias voltage control process. The image forming control unit 13 controls electric potential of the developing roller 309*a* by performing the first bias voltage control process and controlling the first bias voltage.

The image forming control unit 13 controls the second bias voltage applied to the counter roller 312 by the second bias voltage applying unit 313 by performing the second bias voltage control process. The image forming control unit 13 controls electric potential of the counter roller 312 by performing the second bias voltage control process and controlling the second bias voltage.

In the image forming apparatus 100 according to the second embodiment configured as such, the image carrier 310 that transmits the light of the first wavelength at the certain third transmittance is arranged opposite to the counter roller 312 with the sheet interposed therebetween. Accordingly, the image forming apparatus 100 may simultaneously melt, transfer, and fix the toner image, and upsizing of an image forming apparatus forming an image by an electrophotographic method may be suppressed.

In the image forming apparatus 100 according to the second embodiment configured as such, the light emitting unit 308*a* is located in the hollow region of the image carrier 310. When the light emitting unit 308*a* is located outside the image carrier 310, the light of the first wavelength emitted by the light emitting unit 308*a* is unable to reach the image carrier contact point unless the light passes through the surface of the image carrier 310 two times. Meanwhile, when the light emitting unit 308*a* is located in the hollow region of the image carrier 310, the light of the first wavelength emitted by the light emitting unit 308*a* reaches the image carrier contact point by passing through the surface of the image carrier 310 only one time. Accordingly, when the light emitting unit 308*a* is located in the hollow region of the image carrier 310, attenuation of light intensity of the light of the first wavelength caused by passing through the image carrier 310 may be suppressed compared to when the light emitting unit 308*a* is located outside the image carrier 310. Also, when the light emitting unit 308*a* is located outside the image carrier 310, the toner adsorbs the light of the first wavelength at a location other than the image carrier contact point. However, when the light emitting unit 308*a* is located in the hollow region of the image carrier 310, the toner adsorbs the light of the first wavelength at the image carrier contact point, but does not adsorb the light of the first wavelength at other locations. Thus, when the light emitting unit 308*a* is located in the hollow region of the image carrier 310, deterioration of image quality of the toner image according to the image data may be suppressed compared to when the light emitting unit 308*a* is located outside the image carrier 310.

Third Embodiment

Hereinafter, an image forming apparatus 100 according to a third embodiment will be described.

In the image forming apparatus 100 according to the third embodiment, an image forming unit 3*b* is different from the image forming unit 3 of the first embodiment. Also, in the image forming apparatus 100, the image forming control unit 13 is different from the image forming control unit 13 of the first embodiment. According to the third embodiment, the sheet may be any sheet as long as an image is formable by the image forming apparatus 100. Unlike the sheet of the first embodiment, the sheet of the third embodiment does not necessarily need to transmit the light of the first wavelength at the first transmittance.

Also, a concrete example of a hardware structure of the image forming apparatus 100 according to the third embodiment is the same as that of FIG. 1 except functions of the image forming unit 3*b* and the image forming control unit 13.

Hereinafter, components other than the image forming unit 3*b* and the image forming control unit 13, which have the same functions as those of the second embodiment, will be denoted by the same reference numerals and details thereof will not be repeated.

Figure 4:
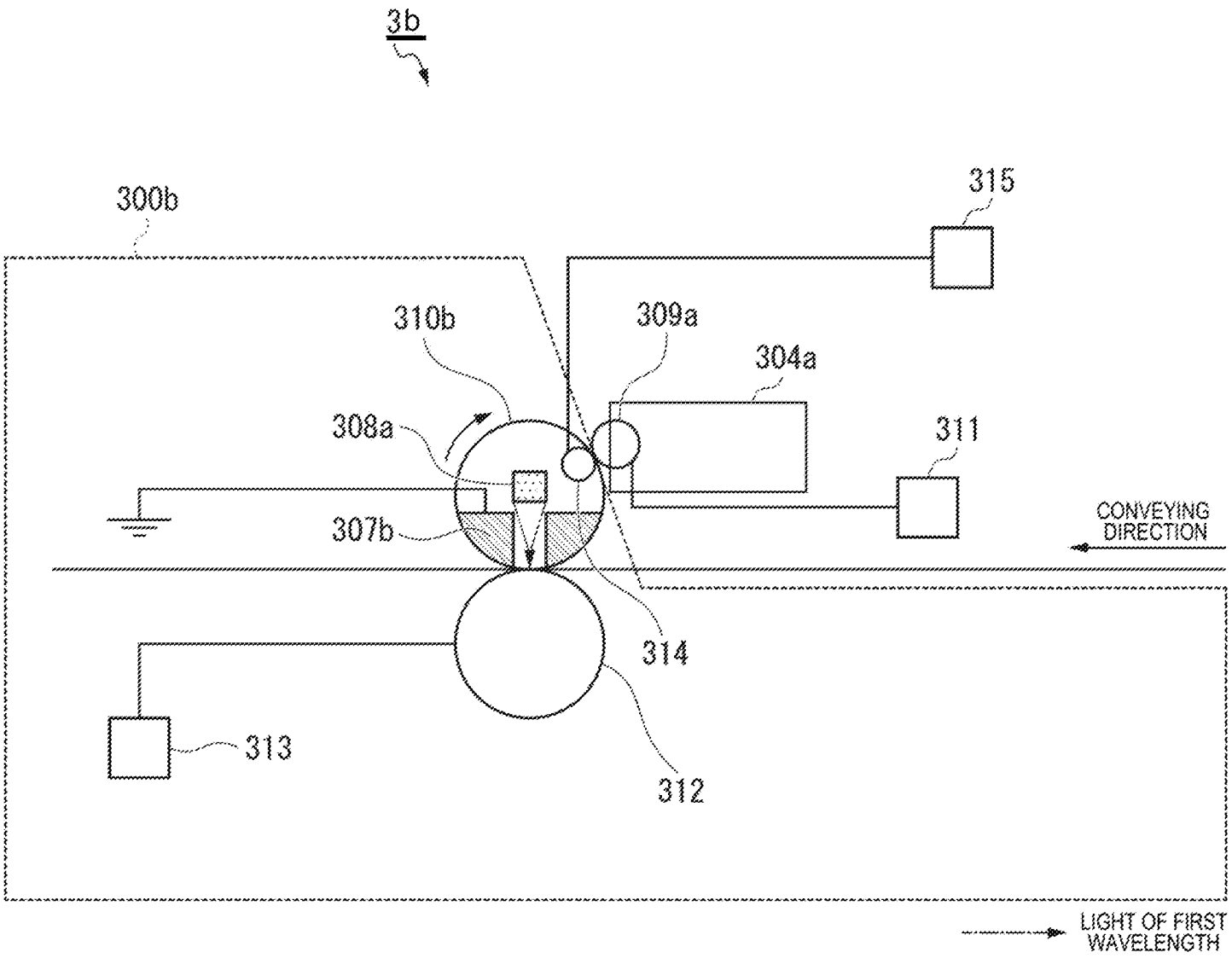
FIG. 4 is a cross-sectional view illustrating a concrete example of an image forming unit according to a third embodiment.

FIG. 4 is a cross-sectional view illustrating a concrete example of the image forming unit 3*b* according to the third embodiment. The image forming unit 3*b* is different from the image forming unit 3*a* in the second embodiment in that the image forming unit 3*b* includes an image carrier 310*b* instead of the image carrier 310, a guide member 307*b* instead of the guide member 307*a*, an electrode unit (electrode array) 314, and a third bias voltage applying unit 315.

The image carrier 310*b* is a rotating member with a hollow inside. The toner may be adsorbed onto a surface of the image carrier 310*b*. The surface of the image carrier 310*b* transmits the light of the first wavelength at the third transmittance. In detail, the surface of the image carrier 310*b* may be formed of a transparent material capable of transmitting a laser beam absorbed by the toner.

The guide member 307*b* is located in a hollow region of the image carrier 310*b* that is on a path through which the light of the first wavelength is transmitted, and guides the sheet to a certain destination. The guide member 307*b* is grounded, and has electric potential of about 0 V. The guide member 307*b* transmits the light of the first wavelength. For example, the guide member 307*b* includes an opening at one portion thereof to transmit the light of the first wavelength. The guide member 307*b* may be formed of, for example, ITO. Hereinafter, for convenience of description, it is assumed that the guide member 307*b* includes the opening to transmit the light of the first wavelength. The guide member 307*b* applies pressure to the sheet. The toner is fixed to the sheet by the pressure applied by the guide member 307*b*.

The guide member 307*b* may include two members with a gap therebetween. The light of the first wavelength passes through the gap in the guide member 307*b*.

The electrode unit 314 is located in the hollow region of the image carrier 310*b* and includes a plurality of electrodes. Each electrode is arranged at a location facing a surface of the developing roller 309*a* across the surface of the image carrier 310*b*. The electric potential of each electrode is higher than the electric potential of the developing roller 309*a*, and thus draws the toner from the developing roller 309*a* near the electrode. The toner drawn by the electrode unit 314 is adsorbed onto the surface of the image carrier 310*b*.

The third bias voltage applying unit 315 applies a certain voltage (hereinafter, referred to as a "third bias voltage") to the electrode unit 314. The third bias voltage applied to the electrode unit 314 by the third bias voltage applying unit 315 may be any voltage as long as it is higher than electric potential of the surface of the developing roller 309*a*, that is, a voltage capable of drawing the toner towards the image carrier 310*b*.

Only the toner forming an image represented by the image data is drawn to the sheet by the third bias voltage.

Also, the guide member 307*b*, the light emitting unit 308*a*, the developing roller 309*a*, the image carrier 310*b*, the counter roller 312, the second bias voltage applying unit 313, and the electrode unit 314 may operate together to function as a transferring and fixing device 300*b*.

Figure 5:
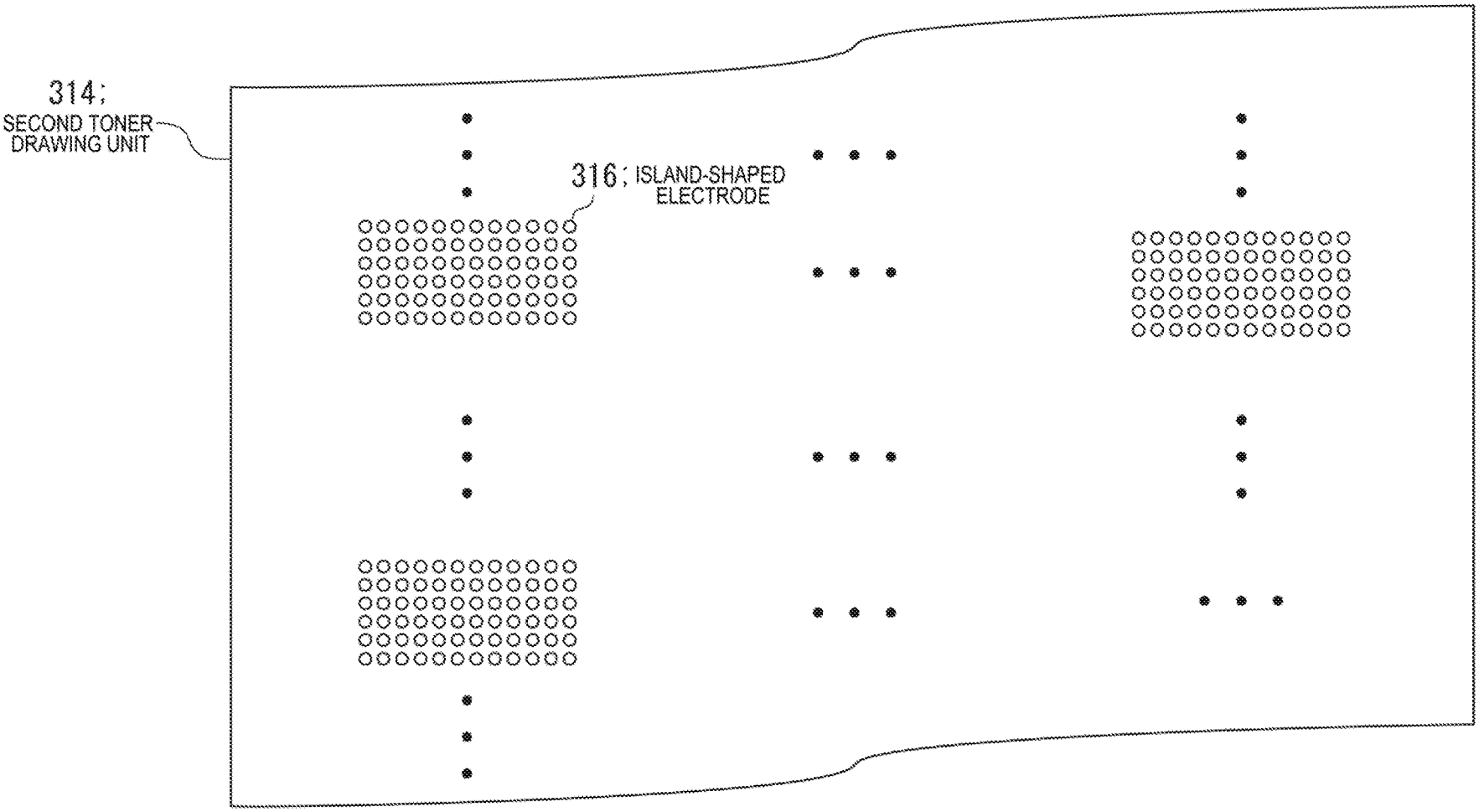
FIG. 5 is a view illustrating a concrete example of an electrode unit according to at least one embodiment.

FIG. 5 is a view illustrating a concrete example of the electrode unit 314 according to at least one embodiment.

FIG. 5 illustrates the electrode unit 314 viewed from the developing roller 309*a*. The electrode unit 314 includes a plurality of island-shaped electrodes (hereinafter, referred to as an "island-shaped electrode 316") in a lattice pattern. The island-shaped electrodes may include round electrodes which are spaced from each other, such as substantially circular electrodes.

Figure 6:
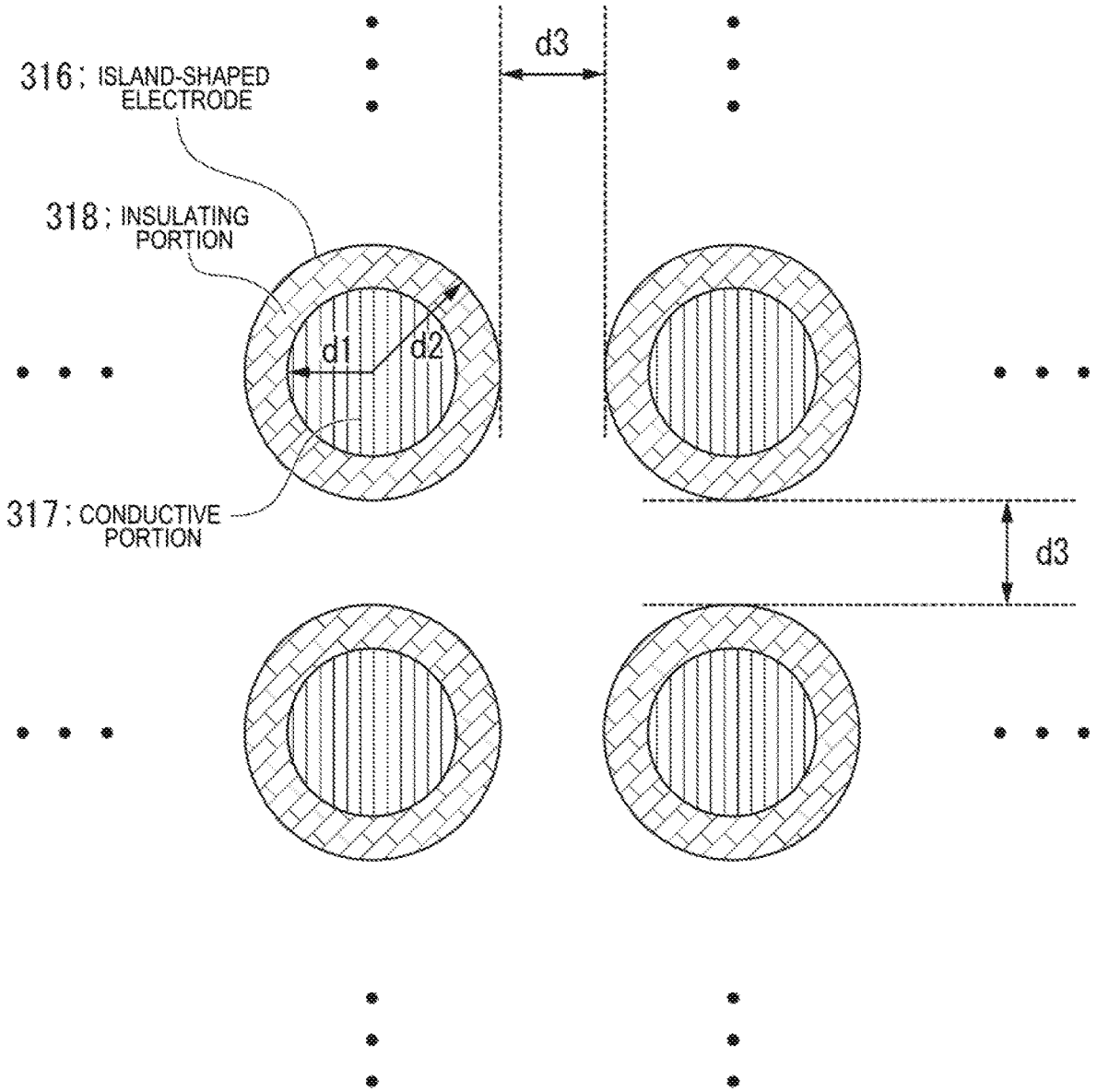
FIG. 6 is a view illustrating a concrete example of an island-shaped electrode according to at least one embodiment.

FIG. 6 is a view illustrating a concrete example of the island-shaped electrode 316 according to at least one embodiment.

The island-shaped electrode 316 includes a conductive portion 317 and an insulating portion 318. The conductive portion 317 is a conductive member (a conductor). The third bias voltage is applied to the conductive portion 317 by the third bias voltage applying unit 315. The electric potential of the conductive portion 317 is the same as electric potential of the third bias voltage. The electric potential of the conductive portion 317 is higher than the electric potential of the surface of the developing roller 309*a*. A shape of the conductive portion 317 is not limited as long as it has a finite size. The conductive portion 317 may have, for example, a circular shape having a radius d1. Hereinafter, for convenience of description, it is assumed that the conductive portion 317 is a circle having the radius d1.

The insulating portion 318 is an insulating member (insulator) surrounding the conductive portion 317. Since the insulating portion 318 is an insulating member, the electric potential is about 0 V even when the third bias voltage is applied, and does not adsorb the toner. A shape of the insulating portion 318 is not limited as long as it is an insulating member surrounding the conductive portion 317. The insulating portion 318 may have, for example, when the conductive portion 317 has a circular shape, an annular shape having a thickness d2–d1. Hereinafter, for convenience of description, it is assumed that when the conductive portion 317 is circular, the insulating portion 318 is annular with the thickness d2–d1.

When a distance between outer circumferences of the island-shaped electrodes 316 is d3, d1, d2, and d3 are not limited as long as they are equal to or smaller than a size of each pixel of the image represented by the image data. For example, d1 may be 0.1 mm. In this case, d2–d1 may be, for example, 0.05 mm. Also, in this case, d3 may be, for example, 0.1 mm.

The toner according to the third embodiment which is melted when the light emitting unit 308*a* emits the light of the first wavelength will be described with reference to FIGS. 7 and 8.

Figure 7:
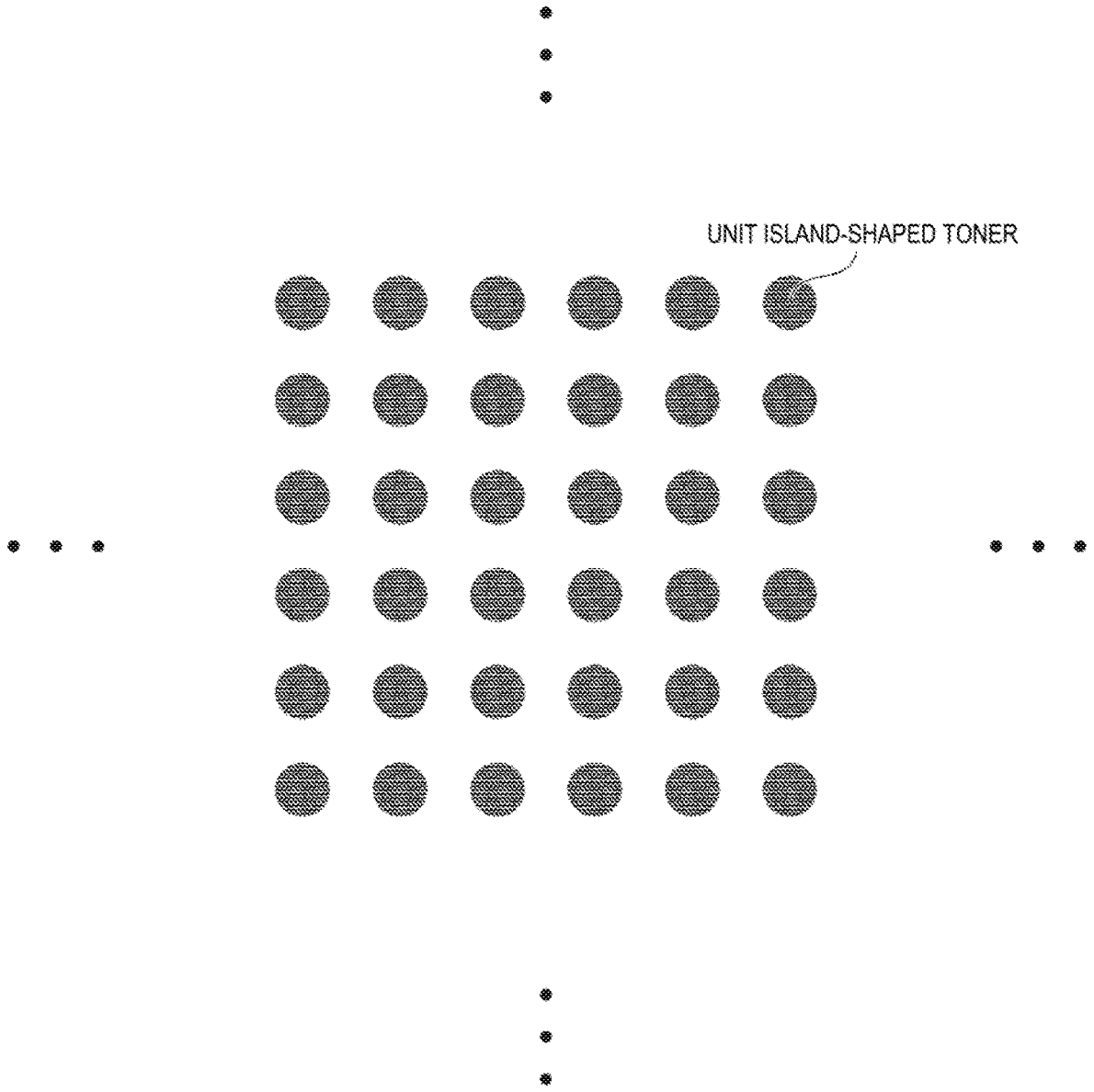
FIG. 7 is a view illustrating a concrete example at a point of time before light of a first wavelength is emitted to toner adsorbed onto a surface of an image carrier, according to the third embodiment.

FIG. 7 is a view illustrating a concrete example at a point of time before the light of the first wavelength is emitted to the toner adsorbed onto the surface of the image carrier 310*b*, according to the third embodiment. The toners supplied by the developing unit 304*a* are adsorbed onto the surface of the image carrier 310*b* in a shape and arrangement approximately the same as those of the island-shaped electrodes 316 of the electrode unit 314 illustrated in FIG. 6. Accordingly, at the point of time before the light of the first wavelength is emitted, the plurality of toners in an island shape (hereinafter, referred to as "unit island-shaped toners") is arranged on the surface of the image carrier 310*b* in a lattice pattern.

Figure 8:
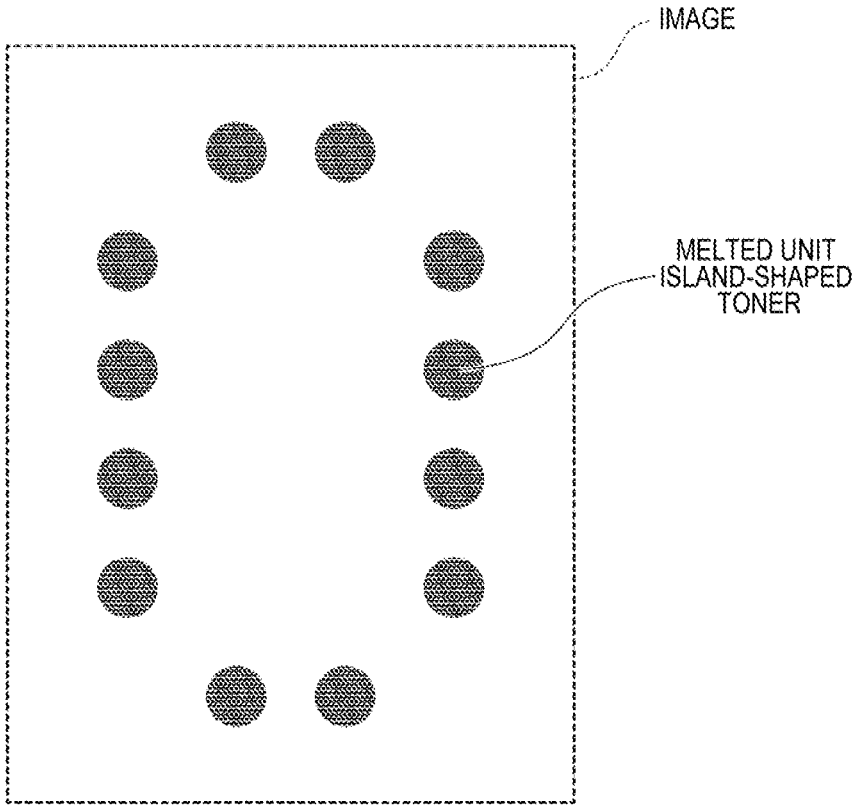
FIG. 8 is a view illustrating a concrete example of unit island-shaped toner melted according to irradiation with the light of the first wavelength, according to the third embodiment.

FIG. 8 is a view illustrating a concrete example of the unit island-shaped toner melted by emitting the light of the first wavelength, according to the third embodiment. A unit island-shaped toner, to which the light of the first wavelength is emitted among the plurality of unit island-shaped toners formed on the surface of the image carrier 310*b* in a lattice pattern, is melted and fixed to the sheet. A unit island-shaped toner, to which the light of the first wavelength is not emitted among the plurality of unit island-shaped toners formed on the surface of the image carrier 310*b* in a lattice pattern, is not melted. An image formed by the melted unit island-shaped toner is the image represented by the image data.

Also, an image formed by the toner adsorbed onto the surface of the image carrier 310*b* before the light of the first wavelength is emitted is a toner image having a shape and arrangement approximately the same as those of the island-shaped electrodes 316 of the electrode unit 314. The toner image having a shape and arrangement approximately the same as those of the island-shaped electrodes 316 of the electrode unit 314 is a toner image irrelevant to the image data.

Also, a spot size of the light emitted by the light emitting unit 308*a* to the image carrier contact point is approximately the same as a size of the island-shaped electrode 316. For example, when d1, d2, and d3 are respectively 0.1 mm, 0.05 mm, and 0.1 mm, the light emitting unit 308*a* may concentrate the light in a circle having a radius of 0.1 to 0.15 mm.

Hereinafter, the image forming unit 3*b* according to the third embodiment has been described. Next, the image forming control unit 13 according to the third embodiment will be described. The image forming control unit 13 according to the third embodiment performs an image carrier control process, a second light emitting control process, a first bias voltage control process, a second bias voltage control process, and a third bias voltage control process.

The image forming control unit 13 performs the third bias control process to control the third bias voltage applied to the electrode unit 314 by the third bias voltage applying unit 315. The image forming control unit 13 controls the electric potential of the electrode unit 314 by performing the third bias voltage control process to control the third bias voltage.

Also, the guide member 307*b*, the light emitting unit 308*a*, the image carrier 310*b*, the counter roller 312, the second bias voltage applying unit 313, and the electrode unit 314 operate together to function as the transferring and fixing device 300*b*.

Since the image forming apparatus 100 according to the third embodiment configured as such has the electrode unit 314 including the island-shaped electrodes 316 arranged in a lattice pattern, the toner is adsorbed onto the surface of the image carrier 310*b* at a distance.

Generally, light is known to have a diffraction limit. The diffraction limit is a limit of a spatial region where light can concentrate. This means that light may be concentrated only in a desired spatial region. Thus, in an image forming apparatus that does not include the electrode unit 314, even when the light of the first wavelength is concentrated on the toner up to a diffraction limit, the toner in a region other than a desired region may also melt.

However, the image forming apparatus 100 according to the third embodiment including the electrode unit 314 adsorbs the toner onto the surface of the image carrier 310*b* at a distance. Thus, the image forming apparatus 100 according to the third embodiment configured as such may reduce a possibility that the toner may melt in a region other than a desired region.

Since the island-shaped electrode 316 according to the third embodiment configured as such includes the insulating portion 318, electromagnetic separation between the island-shaped electrodes 316 is stronger than that between the island-shaped electrodes 316 that do not include the insulating portion 318. Accordingly, the image forming apparatus 100 according to the third embodiment configured as such may reduce a possibility that the toner in a region other than a desired region may melt compared to when the insulating portion 318 is not provided.

Also, the island-shaped electrodes 316 arranged in a lattice pattern do not necessarily include the electrode unit 314, but the developing roller 309*a* may include the electrode unit 314.

Also, the island-shaped electrodes 316 do not necessarily need to be arranged in a lattice pattern, but may be arranged in any pattern as long as they are periodically arranged one-dimensionally or 2-dimensionally. For example, the island-shaped electrodes 316 may be arranged in a honeycomb pattern.

Like the image forming apparatus 100 according to the second embodiment, the image forming apparatus 100 according to the third embodiment configured as such includes the light emitting unit 308*a* in the hollow region of the image carrier 310*b*. Thus, the image forming apparatus 100 according to the third embodiment configured as such has the same effects as the image forming apparatus 100 according to the second embodiment, by including the light emitting unit 308*a* in the hollow region of the image carrier 310*b*.

Fourth Embodiment

Hereinafter, an image forming apparatus 100 according to a fourth embodiment will be described.

In the image forming apparatus 100 according to the fourth embodiment, an image forming unit 3*c* is different from the image forming unit 3 of the first embodiment. Also, in the image forming apparatus 100, the image forming control unit 13 is different from the image forming control unit 13 of the first embodiment. According to the fourth embodiment, the sheet may be any sheet as long as an image is formable by the image forming apparatus 100. The sheet according to the fourth embodiment is not limited as long as an image is formable by the image forming apparatus 100 and the light of the first wavelength is transmitted at the certain first transmittance. Also, a concrete example of a hardware structure of the image forming apparatus 100 according to the fourth embodiment is the same as that of FIG. 1 except functions of the image forming unit 3*c* and the image forming control unit 13.

Hereinafter, components other than the image forming unit 3*c* and the image forming control unit 13, which have the same functions as those of the second embodiment, will be denoted by the same reference numerals and details thereof will not be repeated.

Figure 9:
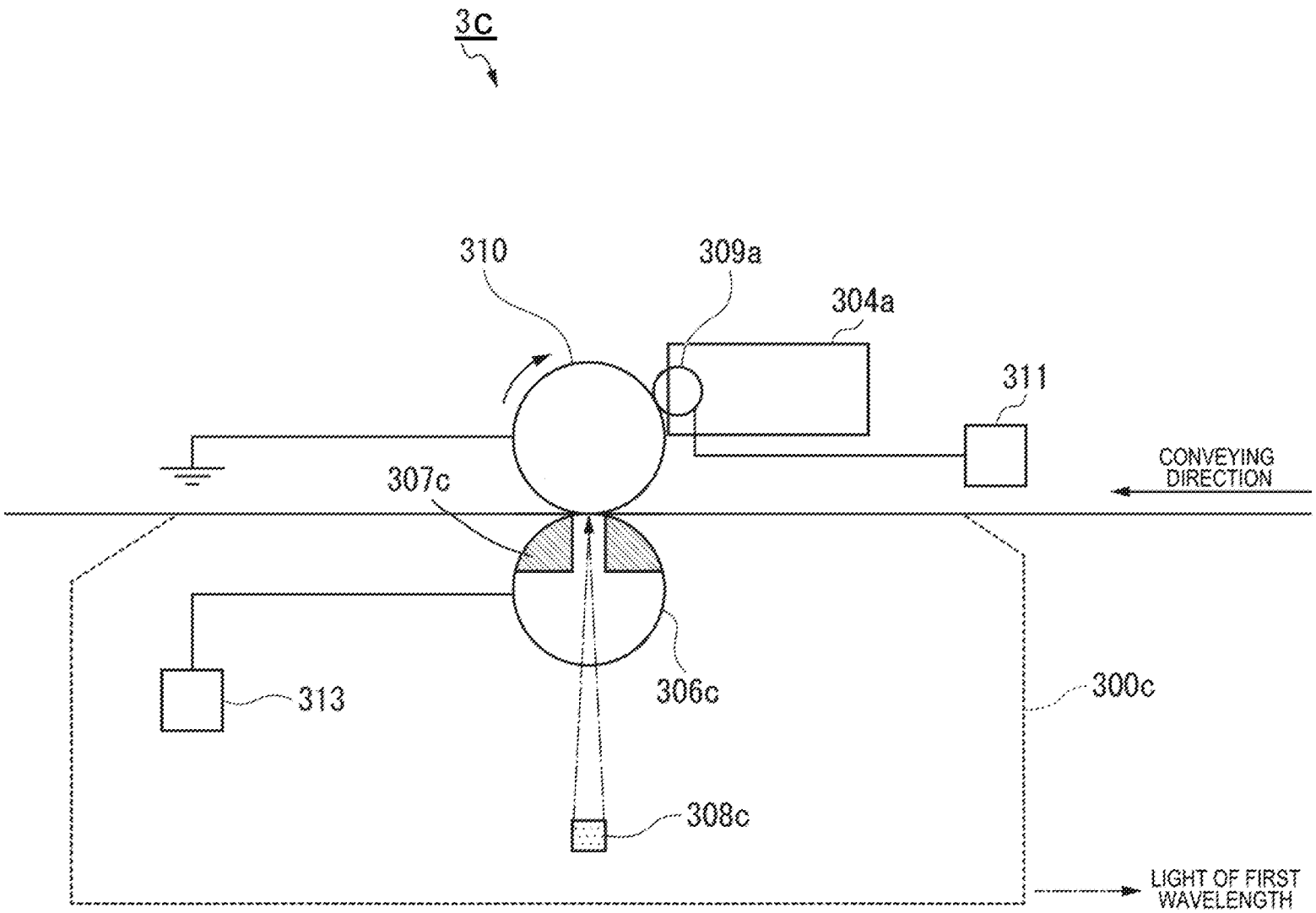
FIG. 9 is a cross-sectional view illustrating a concrete example of an image forming unit according to a fourth embodiment.

FIG. 9 is a cross-sectional view illustrating a concrete example of the image forming unit 3*c* according to the fourth embodiment. The image forming unit 3*c* is different from the image forming unit 3*a* of the second embodiment in that the image forming unit 3*c* includes a guide member 307*c* instead of the guide member 307*a*, a transparent conveyor roller 306*c* instead of the counter roller 312, and a light emitting unit 308*c* instead of the light emitting unit 308*a*.

The transparent conveyor roller 306*c* is a transparent roller that transmits the light of the first wavelength at a certain fourth transmittance, and conveys the sheet by rotating. The transparent conveyor roller 306*c* is arranged opposite to the image carrier 310 with the sheet interposed therebetween. In other words, the transparent conveyor roller 306*c* and the image carrier 310 are arranged opposite to each other across the sheet. The transparent conveyor roller 306*c* inserts the sheet between the transparent conveyor roller 306*c* and the image carrier 310. Hereinafter, a point where the image carrier 310 and the sheet contact each other will be referred to as an image carrier contact point. Hereinafter, a point where the transparent conveyor roller 306*c* and the sheet contact each other will be referred to as a roller contact point. Hereinafter, a direction in which the transparent conveyor roller 306*c* is located when viewed from the sheet will be referred to as a roller direction. Hereinafter, in the fourth embodiment, a surface of the sheet where the image carrier 310 is located will be referred to as an image carrier side sheet surface. Hereinafter, a surface of the sheet where the transparent conveyor roller 306*c* is located will be referred to as a roller side sheet surface.

Also, the transparent conveyor roller 306*c* applies, to the toner adsorbed onto the image carrier 310, a certain electric field according to an electric potential difference between the image carrier 310 and the transparent conveyor roller 306*c*. The transparent conveyor roller 306*c* draws the toner adsorbed onto the image carrier 310 according to the applied electric field.

The guide member 307*c* may be located, for example, in a hollow region of the transparent conveyor roller 306*c* that is on a path through which the light of the first wavelength is transmitted, and guides the sheet to a certain destination. The guide member 307*c* transmits the light of the first wavelength. For example, the guide member 307*c* includes an opening at one portion thereof to transmit the light of the first wavelength. The guide member 307*c* may be formed of, for example, indium tin oxide (ITO). Hereinafter, for convenience of description, it is assumed that the guide member 307*c* includes the opening to transmit the light of the first wavelength. The guide member 307*c* applies pressure to the sheet. The toner is fixed to the sheet by the pressure applied by the guide member 307*c*.

The guide member 307*c* may include two members with a gap therebetween. The light of the first wavelength passes through the gap in the guide member 307*c*.

Also, the guide member 307*c* is grounded and has a defined electric potential (e.g., an electric potential of about 0 V). The guide member 307*c* applies pressure to the sheet. The toner is fixed to the sheet by the pressure applied by the guide member 307*c*.

The light emitting unit 308*c* emits the light of the first wavelength towards the image carrier contact point such that the light of the first wavelength is incident on the image carrier contact point from a conveyor roller direction. The conveyor roller direction is a direction where the transparent conveyor roller 306*c* is located when viewed from the sheet.

Next, the light of the first wavelength incident on the image carrier contact point from the conveyor roller direction will be described with reference to FIG. 9.

The light of the first wavelength irradiated from the light emitting unit 308*c* is incident on the surface of the transparent conveyor roller 306*c*. The transparent conveyor roller 306*c* transmits the light of the first wavelength at the certain fourth transmittance. Accordingly, a part of the light of the first wavelength incident on the surface of the transparent conveyor roller 306*c* passes through the transparent conveyor roller 306*c*, and incident on a conveyor roller contact point of the roller side sheet surface. Also, the roller side sheet surface is a surface of the sheet where the transparent conveyor roller 306*c* is located. Also, the conveyor roller contact point is a point where the transparent conveyor roller 306*c* and the sheet contact each other. Since the sheet transmits the light of the first wavelength at the certain first transmittance, and the light of the first wavelength incident on the conveyor roller contact point of the roller side sheet surface is incident on the image carrier contact point from the conveyor roller direction.

As such, the light of the first wavelength is incident on the image carrier contact point from the conveyor roller direction.

Hereinafter, the image forming unit 3*c* according to the fourth embodiment has been described. Next, the image forming control unit 13 according to the fourth embodiment will be described. The image forming control unit 13 according to the fourth embodiment is different from the image forming control unit 13 according to the second embodiment in that it performs a third light emitting control process instead of the second light emitting control process.

The image forming control unit 13 according to the fourth embodiment controls operations of the light emitting unit 308*c* by performing the third light emitting control process. The image forming control unit 13 according to the fourth embodiment causes the light emitting unit 308*c* to emit the light of the first wavelength at timing based on the rotating speed of the image carrier 310 and the image data, by performing the third light emitting control process and controlling operations of the light emitting unit 308*c*.

Also, the transparent conveyor roller 306*c*, the guide member 307*c*, the light emitting unit 308*c*, and the second bias voltage applying unit 313 operate together to function as a transferring and fixing device (an image fixation apparatus) 300*c*.

In the image forming apparatus 100 according to the fourth embodiment configured as such, the transparent conveyor roller 306*c* transmitting the light of the first wavelength at the certain fourth transmittance and the image carrier 310 are arranged opposite to each other with the sheet interposed therebetween. Accordingly, the image forming apparatus 100 according to the fourth embodiment may melt, transfer, and fix the toner image simultaneously, and upsizing of an image forming apparatus forming an image via an electrophotographic method may be suppressed.

Modified Example

Also, the image forming apparatus 100 according to the fourth embodiment may include the electrode unit 314, the third bias voltage applying unit 315, and a third bias voltage control unit, according to the third embodiment. In this case, since the image forming apparatus 100 according to the fourth embodiment includes the electrode unit 314 including the island-shaped electrodes 316 arranged in a lattice pattern, a possibility that the toner in a region other than a desired region melt may be reduced.

Also, the light emitting units 308*a* according to the second embodiment and the third embodiment may not be necessarily located in the hollow regions of the image carrier 310 and the image carrier 310*b*. The light emitting units 308*a* according to the second embodiment and the third embodiment may be located outside the image carrier 310 and the image carrier 310*b*.

The photoconductor 301 does not necessarily need to contact the sheet, but may be near the sheet. Also, the transparent conveyor rollers 306 and 306*c* do not necessarily need to contact the sheet, but may be near the sheet. Also, the image carrier 310 does not necessarily need to contact the sheet, but may be near the sheet.

The sheet is not limited as long as an image is formable by the image forming apparatus 100. The sheet may be a roll-type medium, a film-type long medium, or a film sheet as long as the image forming apparatus 100 can form an image on a surface thereof.

The light of the first wavelength is not limited as long as it can melt the toner. The light of the first wavelength may be, for example, infrared rays, terahertz waves, ultraviolet rays, or visible light.

The first transmittance, the second transmittance, the third transmittance, and the fourth transmittance may be any transmittance as long as they are each equal to or higher than a certain value (a predetermined value or a reference value that may be set in advance), such that the transmittance may be a defined transmittance. Generally speaking, it is more advantageous to have a higher first transmittance, second transmittance, third transmittance, and fourth transmittance.

Each function of the image forming apparatus 100 may be entirely or partially implemented by using hardware, such as an application specific integrated circuit (ASIC), programmable logic device (PDL), field programmable gate array (FPGA), or the like. A program is recorded in a computer-readable recording medium. The computer-readable recording medium is, for example, a storage device, such as a portable medium such as a flexible disk, a magneto-optical disk, ROM, CD-ROM, or the like, a storage device such as a hard disk embedded in a computer system, or the like. The program may be transmitted through an electric communication line.

Also, the communication unit 5 is an example of an acquiring unit. The developing unit 304 and the developing unit 304*a* according to the fourth embodiment are examples of a developing unit. The developing units 304*a* according to the second embodiment and the third embodiment are examples of a developing unit. Also, the sheet is an example of an image forming target medium. Also, the photoconductor 301 and the image carriers 310 and 310*b* are examples of an image carrier. Also, the image carrier contact point is an example of a point where an image forming target medium adjacent to the image carrier and the image carrier are adjacent to each other. Also, the transferring and fixing devices 300 and 300*c* are examples of a transferring and fixing device. Also, the transferring and fixing devices 300*a* and 300*b* are examples of a transferring and fixing device.

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an acquisition interface configured to acquire image data;

a developer configured to supply toner to an image carrier to form one of a toner image according to the image data or a toner image of a shape which is pre-determined without regard to the image data; and an image fixation apparatus configured to form an image represented by the image data on an image forming target medium by irradiating a surface of the image forming target medium having another surface adjacent to the toner image with light having at least a set value of a transmittance with respect to the image forming target medium, to thereby transfer and simultaneously fix at least a portion of the toner image on the other surface of the image forming target medium by light that is transmitted through the surface of the image forming target medium.

2. The image forming apparatus according to claim 1, wherein the image fixation apparatus is configured to melt the toner via the light.

3. The image forming apparatus according to claim 1, wherein, when a toner image formed by the developer is the toner image having the pre-determined shape, the image fixation apparatus is configured to emit light corresponding to the image data acquired by the acquisition interface.

4. An image forming apparatus comprising:

an acquisition interface configured to acquire image data;

a developer configured to supply toner to an image carrier to form a toner image of a shape which is pre-determined without regard to the image data; and a transferring and fixing device configured to transfer at least one toner image according to the image data to an image forming target medium by emitting light corresponding to the image data acquired by the acquisition interface to a region where the image carrier and the image forming target medium are adjacent to each other, and at the same time, fix the toner image according to the image data.

5. The image forming apparatus according to claim 4, wherein the transferring and fixing device is configured to melt the toner by emitting the light.

6. The image forming apparatus according to claim 4, wherein the image carrier comprises transparent material that transmits the light with a defined transmittance, and the transferring and fixing device comprises, inside the image carrier, a light emitter configured to radiate the light.

7. The image forming apparatus according to claim 4, wherein the transferring and fixing device comprises an electrode array comprising a plurality of electrodes that are periodically arranged one-dimensionally or two-dimensionally, an electric potential of the plurality of electrodes is different from an electric potential of the developer, the developer is configured to supply toner to the image carrier such that the developer causes the toner to be absorbed onto the image carrier in a shape and arrangement identical to an arrangement of the plurality of electrodes, and for each of the plurality of electrodes, an electromagnetic force is generated in the electrode array by an electric potential difference between the electric potential of the plurality of electrodes and the electric potential of the developer, and a spot size of the light irradiated by the transferring and fixing device at the region where the image carrier and the image forming target medium are adjacent to each other is the same as a size of the plurality of electrodes.

8. The image forming apparatus according to claim 7, wherein at least one of the electrodes included in the electrode array includes a conductor and an insulator, and the insulator surrounds the conductor.

9. The image forming apparatus according to claim 4, wherein the transferring and fixing device includes a counter roller having a defined electric potential and arranged opposite to the image carrier, with the image forming target medium interposed therebetween, and is configured to press the toner onto the image forming target medium by an electromagnetic force generated by an electric potential difference between the image carrier and the counter roller.

10. The image forming apparatus according to claim 4, wherein:

the transferring and fixing device further includes a guide located on a path of emitted light so as to direct the light, and the guide is configured to convey the image forming target medium to a destination.

11. An image forming method comprising:

acquiring image data;

supplying toner to an image carrier to form a toner image of a shape which is pre-determined without regard to the image data;

emitting light that corresponds to the acquired image data; and melting, by the emitted light, the toner to a region where the image carrier and an image forming target medium are adjacent to each other so as to transfer a toner image according to the image data to the image forming target medium, and at the same time, fix the toner image according to the image data.

12. The image forming method of claim 11, wherein the melting of toner, the transferring of the toner image, and the fixing of the toner image are performed simultaneously.

13. The image forming method according to claim 11, wherein:

the image carrier comprises transparent material that transmits the light with a defined transmittance, and the image carrier includes a light emitter configured to radiate light.

14. The image forming method according to claim 11, wherein:

the fixing of the toner image is carried out by an image fixation apparatus comprising a plurality of electrodes;

an electric potential of the plurality of electrodes is different from an electric potential of a developer that supplies toner to the toner image, the toner is absorbed onto the image carrier in an arrangement identical to an arrangement of the plurality of electrodes, for the plurality of electrodes, an electromagnetic force is generated by an electric potential difference between the electric potential of the plurality of electrodes and the electric potential of the developer, and a spot size of the light irradiated at the region where the image carrier and the image forming target medium are adjacent to each other is the same as a size of the plurality of electrodes.

15. The image forming method according to claim 14, wherein the electrode included in the electrode array includes a conductor and an insulator, and the insulator surrounds the conductor.

16. The image forming method according to claim 14, further comprising arranging the plurality of electrodes in a lattice pattern.

17. The image forming method according to claim 11, further comprising:

arranging, opposite to the image carrier, a counter roller having a defined electric potential such that the counter roller is positioned between the image carrier and the image forming target medium, and pressing, by the counter roller, the toner onto the image forming target medium by an electromagnetic force generated by an electric potential difference between the image carrier and the counter roller.

18. The image forming method according to claim 11, further comprising:

positioning a guide on a path of the emitted light so as to direct the light, and conveying, via the guide, the image forming target medium to a destination.

* * * * *